US008070438B2

(12) United States Patent
Evans

(10) Patent No.: US 8,070,438 B2
(45) Date of Patent: Dec. 6, 2011

(54) FAN BLADE FOR A GAS TURBINE ENGINE

(75) Inventor: Dale E Evans, Derby (GB)

(73) Assignee: Rolls-Royce PLC, London (GB)

( * ) Notice: Subject to any disclaimer, the term of this patent is extended or adjusted under 35 U.S.C. 154(b) by 895 days.

(21) Appl. No.: 11/819,094

(22) Filed: Jun. 25, 2007

(65) Prior Publication Data

US 2008/0159866 A1 Jul. 3, 2008

(30) Foreign Application Priority Data

Jul. 21, 2006 (GB) ..... 0614518.9

(51) Int. Cl.
*F01D 5/12* (2006.01)

(52) U.S. Cl. ..... 416/2; 416/193 A

(58) Field of Classification Search ..... 415/9; 416/2, 416/193 A, 191, 193 R, 248
See application file for complete search history.

(56) References Cited

U.S. PATENT DOCUMENTS 3,393,862 A * 7/1968 Harrison ..... 416/214 R
3,801,222 A 4/1974 Violette
4,019,832 A 4/1977 Salemme et al.
4,655,687 A * 4/1987 Atkinson ..... 416/193 A
5,464,326 A * 11/1995 Knott ..... 416/193 A
5,890,874 A * 4/1999 Lambert et al. ..... 416/193 A
5,957,658 A 9/1999 Kasprow et al.
6,146,099 A * 11/2000 Zipps et al. ..... 416/193 A

FOREIGN PATENT DOCUMENTS

DE 2 307 967 A1 9/1973
EP 1 167 688 A2 1/2002
GB 669 117 A 3/1952
GB 1 331 209 9/1973

* cited by examiner

*Primary Examiner* — Edward Look
*Assistant Examiner* — Jesse Prager
(74) *Attorney, Agent, or Firm* — Oliff & Berridge PLC

(57) ABSTRACT

An injection-molded thermoplastic mini-platform is adhesively bonded, in use, to the aerofoil surfaces of a fan blade in a gas turbine engine. The mini-platform is divided into a number of leaves, to increase its flexibility, and ribs beneath the leaves provide additional stiffness in the radial direction. In the event that a fan blade is released in operation, the mini-platform is designed to detach from the blade and/or to break apart, so that damage to other components of the engine is minimized.

10 Claims, 2 Drawing Sheets

FAN BLADE FOR A GAS TURBINE ENGINE

This invention relates to gas turbine engines, and more particularly to fan blade assemblies in such engines.

Commonly, the root portions of a set of fan blades locate in corresponding axially-extending slots circumferentially spaced around a fan disc. To fill the spaces between the fan blades and to define the inner wall of the flow annulus, annulus fillers are used. Typically, these are located in circumferentially-extending slots in the fan disc.

To remove an annulus filler, a number of fan blades must first be removed. The annulus fillers may then be "shuffled" circumferentially until the filler to be removed is clear of its mounting slot. To facilitate this, fan blades are commonly provided with "mini-platforms". Mini-platforms extend generally circumferentially from the aerofoil surfaces of the blade, near to the root portion, and align, in use, with the annulus fillers. The mini-platforms provide some of the circumferential width that would otherwise have to be provided by the annulus fillers. When the fan blades are removed there is therefore more space available to shuffle the annulus fillers, and the number of fan blades that must be removed is minimised. Known mini-platforms are integral with the fan blades, being machined into the pressure and suction surfaces during manufacture.

The use of mini-platforms presents certain serious disadvantages in the design and operation of gas turbine engines. Mini-platforms add weight and cost to the fan blades, and it is not possible to use them at all on certain types of fan blades (for example, hollow fan blades). Furthermore, in the event that a fan blade is released during operation of the engine, the geometry of the mini-platform features can cause them to puncture the rear of the fan case of the engine. To guard against this, and because the fan blade itself is made heavier by the mini-platforms, the fan case must be of more substantial construction, adding further weight and cost.

It is therefore an object of the present invention to provide a novel fan blade arrangement which avoids the above-mentioned disadvantages, while still permitting the easy removal of the annulus fillers.

According to the invention, there is provided a mini-platform for a fan blade of a gas turbine engine as claimed in claim 1.

The invention will now be described, by way of example, with reference to the following drawings in which.

Figure 1:
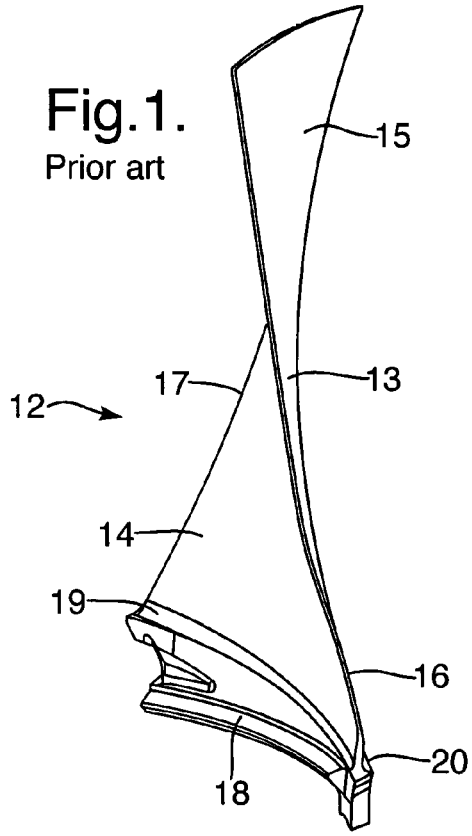
Fig.1. Prior art
FIG. 1 is a perspective view of a fan blade of known type, showing conventional, integral mini-platforms.
Figure 2:
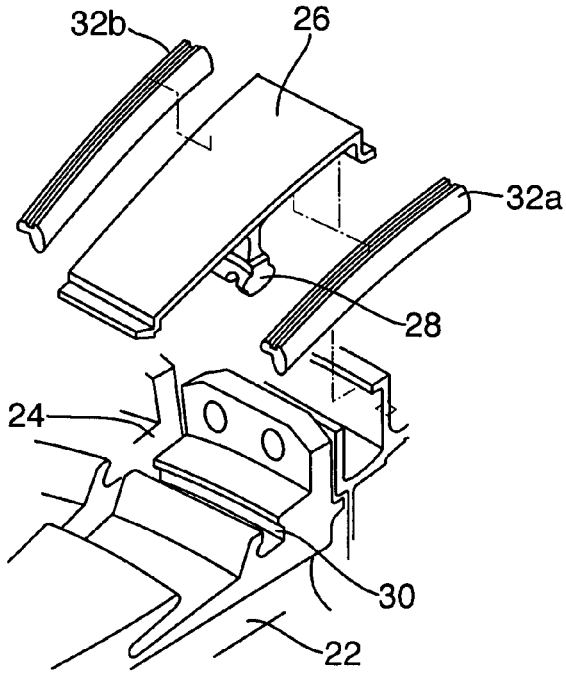
Fig.2. Prior art
FIG. 2 is a perspective view of a known annulus filler arrangement.

FIG. 1 shows a fan blade 12 of known type for a gas turbine engine. The fan blade 12 comprises an aerofoil portion 13, which has a pressure surface 14 and a suction surface 15. The pressure 14 and suction 15 surfaces extend from leading edge 16 to the trailing edge 17 of the fan blade 12. Mini-platforms 19, 20 extend from the aerofoil surfaces 14, 15. The fan blade 12 further comprises a root portion 18 which in use locates in a corresponding axial slot (24 in FIG. 2) in a fan disc (22). A plurality of slots 24 around the periphery of the disc 22 accommodates a set of fan blades 12.

It is usual for fan annulus fillers 26 to be located in the circumferential spaces between the fan blades 12, to provide a smooth surface which will not impede airflow into the engine. Each annulus filler 26 has a root portion 28, which in use locates in a circumferential slot 30 in the fan disc 22. A P-shaped seal 32*a* and a flap seal 32*b* are secured to the sides of the annulus filler 26, and in use bear against the pressure 14 and suction 15 surfaces of two adjacent fan blades 12 to prevent air leakage between the annulus filler 26 and the blades 12.

It is known to provide mini-platform features towards the trailing edge 17 of the fan blade 12, to permit easier removal of the annulus fillers 26. These mini-platform features are machined into the pressure 14 and suction 15 surfaces of the blade 12 during manufacture. In use, the side forces between the mini-platforms and the P-shaped seal 32*a* ensures that the annulus fillers 26 are maintained in their correct circumferential locations.

Figure 3:
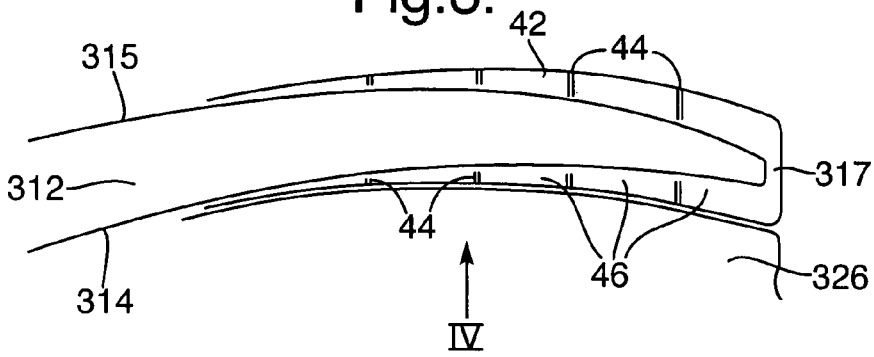
FIG. 3 is a sectional plan view of a fan blade including a mini-platform according to the invention.

FIG. 3 shows the trailing edge portion of a fan blade 312 including a mini-platform according to the invention. The pressure surface 314 and suction surface 315 meet at the trailing edge 317.

A mini-platform 42 is bonded to the trailing edge region of the fan blade 312. The mini-platform 42 is injection moulded from high-strength thermoplastic material. (An example of a suitable thermoplastic material is Torlon®, produced by Solvay.) It is bonded to the fan blade 312 using a suitable adhesive.

The mini-platform 42 moulding includes eight slits 44 which divide the surface of the mini-platform into leaves 46.

Adjacent to one side of the mini-platform 42, part of one annulus filler 326 is shown.

Figure 4:
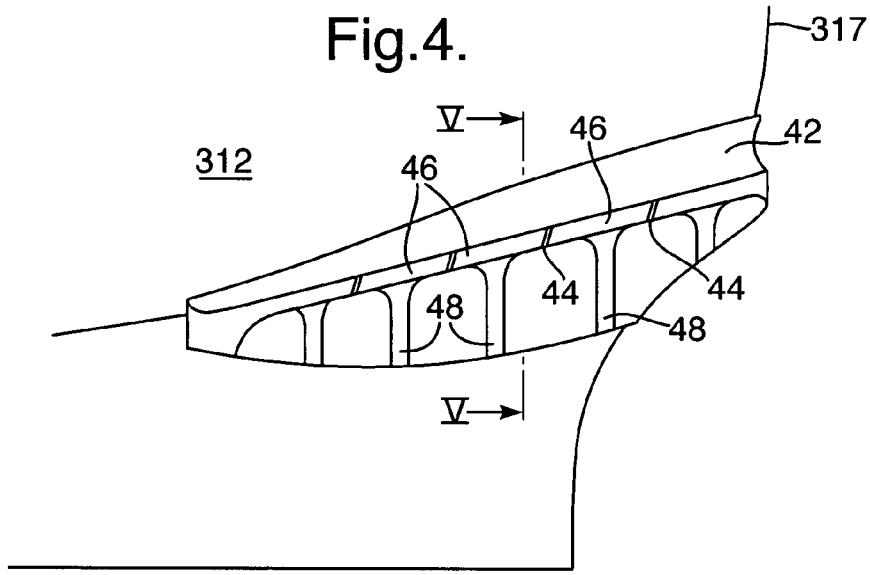
FIG. 4 is a side view of the fan blade of FIG. 3, in the direction of the arrow IV.

In FIG. 4, the mini-platform 42 is bonded to the fan blade 312. Slits 44 divide the mini-platform 42 into leaves 46. Beneath each leaf 46 is a rib 48, which supports the leaf 46. The presence of the rib 48 increases the stiffness of the leaf 46 in the radial direction, while leaving it relatively free to flex in the streamwise direction.

Figure 5:
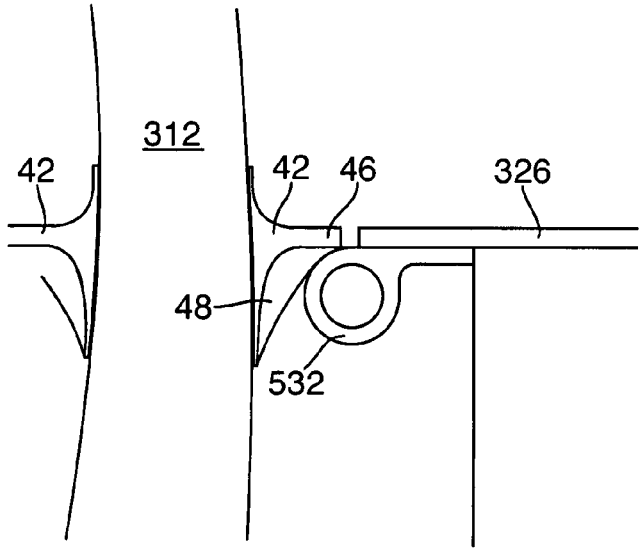
FIG. 5 is a partial sectional view on the line V-V in FIG. 4.

FIG. 5 shows a sectional view of FIG. 4, on the line V-V. The mini-platform 42 is bonded to the fan blade 312, and a rib 48 is visible beneath a leaf 46. The adjacent annulus filler 326 has a P-shaped seal 532, as described in connection with FIGS. 1 and 2. The combination of the rib 48 with the leaf 46 provides sufficient rigidity in the circumferential direction to support the annulus filler 326 in its correct circumferential position.

In the event that a fan blade 312 is released in operation, the mini-platform 42 will tend to detach from the fan blade and/or break into pieces, and so is less likely to cause damage to other parts of the engine. Because it is moulded from thermoplastic material it is also significantly lighter than conventional, metal, integral mini-platforms. The light construction of the mini-platform 42, and its attachment by bonding to the fan blade 312, permit its use on any type of fan blade—even on hollow blades which cannot accommodate conventional mini-platforms.

It will be understood that various modifications may be made to the embodiment described in this specification, without departing from the spirit and scope of the claimed invention.

For example, other materials besides high-strength thermoplastic may be used to form the mini-platform, and it may be fabricated by other means besides injection moulding.

A different number of slits 44 may be employed, if a different number of leaves 46 provides more desirable properties in a particular application.

I claim:

1. A mini-platform for a fan blade of a gas turbine engine, the fan blade having a root portion and an aerofoil portion, the aerofoil portion having a pressure surface and a suction surface, the pressure surface and suction surface each extending between a leading edge and a trailing edge of the aerofoil portion, comprising:

the mini-platform being bonded to the aerofoil portion such that the mini-platform is releasably secured to the aerofoil portion; and the mini-platform including at least one slit to increase its flexibility.

2. A mini-platform as in claim 1, which extends around the trailing edge of the aerofoil portion and is secured to both surfaces of the aerofoil portion.

3. A mini-platform as in claim 1, which is formed of thermoplastic material.

4. A mini-platform as in claim 1, which is formed by injection moulding.

5. A mini-platform as in claim 1, which is adapted to detach from the aerofoil portion during a fan blade off event.

6. A mini-platform as in claim 1, which is adapted to break apart during a fan blade off event.

7. A mini-platform as in claim 1, having a generally L-shaped or T-shaped cross-sectional shape.

8. A mini-platform as in claim 1, comprising at least one rib on its underside to increase its radial stiffness.

9. A fan blade for a gas turbine engine, the fan blade comprising:

at least one mini-platform as in claim 1.

10. A mini-platform as in claim 1, wherein the at least one slit divides the mini-platform into a plurality of leaves.

* * * * *